US007992796B2

(12) United States Patent
Bednarczyk

(10) Patent No.: US 7,992,796 B2
(45) Date of Patent: Aug. 9, 2011

(54) BASE PLATE FOR FASTENING A RAIL ON A SOLID GROUND AND FASTENING OF A RAIL

(75) Inventor: Adrian Bednarczyk, Lüdenscheid (DE)

(73) Assignee: Vossloh-Werke GmbH, Werdohl (DE)

( * ) Notice: Subject to any disclaimer, the term of this patent is extended or adjusted under 35 U.S.C. 154(b) by 0 days.

(21) Appl. No.: 12/607,662

(22) Filed: Oct. 28, 2009

(65) Prior Publication Data

US 2011/0068183 A1 Mar. 24, 2011

(30) Foreign Application Priority Data

Sep. 18, 2009 (DE) ..... 10 2009 041 816

(51) Int. Cl.
*E01B 9/38* (2006.01)

(52) U.S. Cl. ..... 238/264; 238/338

(58) Field of Classification Search ..... 238/264, 238/265, 269, 282, 287, 297, 306, 310, 338, 238/349, 351, 366, 370, 372, 373
See application file for complete search history.

(56) References Cited

U.S. PATENT DOCUMENTS

| | | | | |
|---|---|---|---|---|
| 3,576,293 | A * | 4/1971 | Landis et al. | 238/287 |
| 5,158,414 | A * | 10/1992 | Kais et al. | 238/292 |
| 5,738,278 | A * | 4/1998 | Franz et al. | 238/377 |
| 7,100,837 | B2 * | 9/2006 | Young | 238/382 |
| 7,261,244 | B2 * | 8/2007 | Urmson et al. | 238/287 |
| 7,648,080 | B2 * | 1/2010 | Hohne et al. | 238/351 |
| 7,717,352 | B2 * | 5/2010 | Loffelsend et al. | 238/382 |
| 2003/0085294 | A1 * | 5/2003 | Rada | 238/265 |
| 2004/0200906 | A1 * | 10/2004 | Young | 238/264 |
| 2004/0232254 | A1 * | 11/2004 | Kowalski | 238/264 |
| 2007/0210178 | A1 * | 9/2007 | Nevins | 238/264 |
| 2008/0179419 | A1 * | 7/2008 | Vives Clavel | 238/264 |
| 2008/0265050 | A1 * | 10/2008 | Osler | 238/315 |
| 2009/0302126 | A1 * | 12/2009 | Wirthwein et al. | 238/349 |

FOREIGN PATENT DOCUMENTS

EP 1 950 347 A2 7/2008

* cited by examiner

*Primary Examiner* — S. Joseph Morano
*Assistant Examiner* — Jason C Smith
(74) *Attorney, Agent, or Firm* — The Webb Law Firm

(57) ABSTRACT

A base plate for fastening a rail to a fixed bottom support, having a through-opening which runs from the upper side of the base plate to its underside and through which a clamping bolt having a polygonal head is inserted from the underside, forming in the underside, a receptacle, wherein the head of the clamping bolt is seated. Each side-face of the bolt head has a face for contact formed on the circumferential wall, which extends for part of the length of a side-face of the bolt head, and against which side-face has, planar support. The faces for contact on the circumferential wall are spaced apart from one another. There is formed in the circumferential wall of the receptacle, between each pair of adjacent faces for contact, a recess wherein there is no contact between the bolt head and the circumferential wall of the receptacle.

10 Claims, 6 Drawing Sheets

BASE PLATE FOR FASTENING A RAIL ON A SOLID GROUND AND FASTENING OF A RAIL

The invention relates to a base plate for fastening a rail to a fixed bottom support, having a through-opening which runs from the upper side of the base plate to its underside and through which a clamping bolt having a polygonal head can be inserted from the underside, there being formed or moulded in the underside of the base plate, in the region of the mouth of the through-opening, a receptacle in which the head of the clamping bolt is seated in the fully installed state.

As well as this, the invention relates to a fastener for a rail, which fastener is produced by using a base plate of this kind.

Known in practice is a rail fastening system offered under the name "ECF" in which the rail stands on the supporting surface of a base plate made of steel. At its longitudinal sides which are aligned in the longitudinal direction of the rail which is to be fastened in place, the supporting surface is bounded by respective ribs against which the foot of the rail is guided laterally when in the fully installed state. The rib also acts as a mounting for a clamping bolt whose head seats by positive-fit in a receptacle formed or moulded in the rib and whose shank passes through the central loop of a W-shaped clamping clip in the direction pointing away from the upper side of the base plate. By means of a nut which is screwed onto the clamping bolt, the clamping clip is then braced against the base plate in such a way that a sufficiently high hold-down force is exerted on the given side of the foot of the rail by the free ends of the resilient arms of the clamping clip.

It is ensured in this case that a rail fastener formed by the ECF system has an adequate ability to yield when a railway vehicle travels over it by an elastic intermediate layer, which intermediate layer is arranged between the base plate and a carrier plate which rests on whatever is the solid support in the given case.

To enable the position of the rail to be adjusted to whatever track gauge is required in the given case, there are formed or moulded in the ECF system, in the regions of the base plate which project laterally beyond the supporting surface, respective openings for sleeves, which openings run from the upper sides of the regions to their undersides and have seated in them eccentric sleeves which are designed to form hold-down sleeves. At its end which is at the top in the installed position, the eccentric sleeve has, in this case, a projection in the form of a collar which extends round the circumferential face of the sleeve and which rests on the upper face of the base plate in the installed position. At the same time, the heightwise distance left between the underside of the projecting collar and that end of the eccentric sleeve which is at the bottom in the installed position is of a size such that the sleeve stands on the carrier plate in the fully installed state. Inserted through the opening for the eccentric sleeve in this case is a bolt which is screwed into an anchor inset into the fixed bottom support and which thus creates an axis of rotation for the sleeve. What is achieved by this design is on the one hand that the base plate is braced against the fixed bottom support with a defined hold-down force by means of the eccentric sleeve which acts as a hold-down device. On the other hand, the position of the base plate, and with it the rail standing on it, can be shifted in a direction at right angles to the longitudinal extent of the rail by turning the eccentric sleeve, in order to adjust the position of the rail to the track gauge required.

It is a disadvantage of the known ECF system for fastening a rail in place that the base plate is high in weight and also limits the freedom which exists when designing and configuring it because of the steel material which is used to produce it.

To avoid the disadvantages of base plates of the kind explained above made of steel, a base plates of the kind specified in the opening paragraph has been proposed in EP 1 950 347 A2. The known base plate has, on its underside which is associated with the fixed bottom support, a stiffening structure which is formed by intersecting ribs which between them define respective unfilled recesses. In addition, there are formed or moulded in the base plate through-openings through which a bolt of conventional hexagon-head form can be inserted from the underside of the base plate to act as a clamping bolt to brace a clamping clip against the base plate. For the head of the clamping bolt, there is provided in this case a receptacle which is formed or moulded in the underside of the base plate and which is likewise of a hexagonal form and in which the head of the bolt is seated with positive-fit in the fully installed state.

The base plate known from EP 1 950 347 A2, which is composed of plastics material, is intended to be laid down directly on whatever is the fixed bottom support in the given case. To enable a sufficiently firm hold to be obtained, the known base plate is provided at each of its narrow sides with three through-openings through each of which a fastening bolt which can be screwed into the solid bottom support is inserted. No provision is made in this case either for any adjustment of the track gauge or for the rail to be elastically mounted.

Also, particularly with base plates made of plastics material or of a material which is similarly able to carry only low loads, the problem arises when the clamping clips used to hold down the rail are being clamped that the clamping bolts are not held sufficiently firmly by their heads in the receptacles which are formed or moulded in the underside of the base plate. Instead, the walls yield when the resilient members are being clamped to the torques applied to the clamping bolts, thus allowing the heads of the bolts to turn in the receptacles.

Against the background of the prior art described above, the object of the invention was to provide a base plate in the case of which it is ensured that a polygonal, and in particular hexagonal, bolt head is always securely held in the receptacle associated with it even when acted on by high torques. As well as this, a fastener for a rail was also to be specified in the case of which the risk of the receptacle intended for the polygonal head of a clamping bolt being damaged or destroyed is minimised even when it is acted on by high torques.

With regard to the base plate, the invention has achieved this object by designing the base plate in the manner defined in claim 1. Advantageous embodiments of a base plate according to the invention are specified in the claims which are referred back to claim 1 and they will be explained in detail in what follows.

With regard to the fastener, this object has been achieved by the fastener which is specified in claim 6. Advantageous embodiments of a fastener according to the invention are specified in the claims which are referred back to claim 6 and they will likewise be explained in detail in what follows.

A base plate according to the invention for fastening a rail to a fixed bottom support has, in conformity with the prior art explained above, a through-opening which runs from the upper side of the base plate to its underside and through which a clamping bolt having a polygonal head can be inserted from the underside. There is formed or moulded in this case, in the underside of the base plate, in the region of the mouth of the through-opening, a receptacle in which the head of the clamping bolt is seated in the fully installed state.

Then, in accordance with the invention, each side-face of the bolt head has associated with it a face for contact which is formed on the circumferential wall of the receptacle, which face for contact extends for part of the length of whichever is the associated side-face of the bolt head, and against which the relevant side-face of the bolt head has, in the installed state, planar support. The faces for contact on the circumferential wall are arranged to be spaced apart from one another in this case. At the same time, there is formed or moulded in the circumferential wall of the receptacle, between each pair of adjacent faces for contact, a recess in the region of which there is no contact between the bolt head and the circumferential wall of the receptacle in the fully installed state.

A clamping bolt seated in a receptacle so designed is supported at the side-faces of its head in such a way that it is securely held even under the high torques which may occur when the given resilient member is being braced. Special aids such as inserts made of a stronger material which have to be inserted in the base plates made of plastics material are not required for this purpose.

What is achieved instead by a design according to the invention for the receptacle in the base plate is that even under a high torque loading there is, between the sections of the receptacle which receive the load, planar contact by which the forces to be received are transmitted into the sections of the base plate surrounding the receptacle over a comparably large area. What are prevented in this way are the load peaks which occur in receptacles of conventional design whose shape is a close match to the shape of the bolt head which they are to receive. Because of the inevitable clearance with which the bolt head is seated in its associated receptacle, what regularly arises in this case at the edges situated between the side-faces of the bolt head is a narrow, linear region of contact at which the entire load is concentrated. This concentration of force may become so high that the bolt head works its way into the material surrounding the receptacle and there is no longer any guarantee of the bolt head being securely held. With the planar support for the side-faces of the bolt head which is achieved in accordance with the invention, this danger no longer exists.

Additional protection for the circumferential wall surrounding the receptacle against overloading due to the torques occurring when the given resilient member is clamped can be obtained by forming or moulding an additional load-relieving recess in the region of each of the recesses. The purpose of this provision too is to reduce or prevent peak stresses which cause the material of the circumferential wall to flow or fracture.

The load-relieving recesses are preferably so arranged in this case that the edges present between the side-faces of the bolt head are arranged in the region of the said load-relieving recesses when the clamping bolt is fully installed.

To ensure that the given side-face of the bolt head bears in a defined way against whichever face for contact is associated with it over a sufficiently large area, it has proved beneficial for the faces for contact each to extend across less than half of the associated side-faces of the head of the clamping bolt.

To reliably prevent the edges situated between the side-faces of the bolt head from working their way into the circumferential wall of the receptacle, it may be useful to form the faces for contact to be cambered, namely to be curved in the direction of the centre of the through-opening. When this is the case, the faces for contact are each so formed that it is at most low compressive loads on the circumferential wall of the receptacle which occur in the region of the edges situated between the side-faces.

The invention proves to be particularly advantageous if the base plate is made of a plastics material. Producing it from plastics material on the one hand achieves an appreciable saving in weight in comparison with base plates made of steel or cast iron. In addition, the use of plastics material is a simple way of enabling shapes to be formed on the base plate which cannot be reproduced in steel or similar materials. What may be considered as a plastics material for the production of the base plate is for example glass-fibre reinforced polyamide.

A fastener according to the invention for fastening a rail to a fixed bottom support is constructed on the basis of a base plate designed in accordance with the invention and comprises a clamping bolt which has a polygonal head and in particular one formed after the fashion of a hexagon, which is slid through the through-opening from the underside of the base plate and which is seated in the recess in the base plate by its head. The side-faces of the bolt head are supported in this case against respective ones of the faces for contact formed on the circumferential wall of the recess.

An embodiment of the invention which is of particular importance to the practical user is characterised in that in the installed state the base plate stands on an intermediate layer which is arranged between the base plate and the fixed bottom support. This enables the elasticity of an intermediate layer of comparably large volume to be made use of to give the fastener produced by the system according to the invention, when a railway vehicle travels over it, a yield which, as exactly as possible, can be determined in advance.

On the one hand to ensure that the support which the rail has on the fixed bottom support is as even as possible, but on the other hand to also minimise the abrasive wear on the elastic intermediate layer, there is provided in addition in a fastening system according to the invention a carrier plate which is to be arranged between the intermediate layer and the fixed bottom support. This can if required be made of comparably thin steel sheet or of a sufficiently strong plastics material.

The installation of a fastener according to the invention can be simplified by providing at least one clip which, for installation, holds together in a pre-assembled position a pack made up of the base plate, the intermediate layer situated below it and the carrier plate situated below the intermediate layer.

The invention will be explained in detail below by reference to drawings, which show an embodiment. In the drawings.

Figure 1:
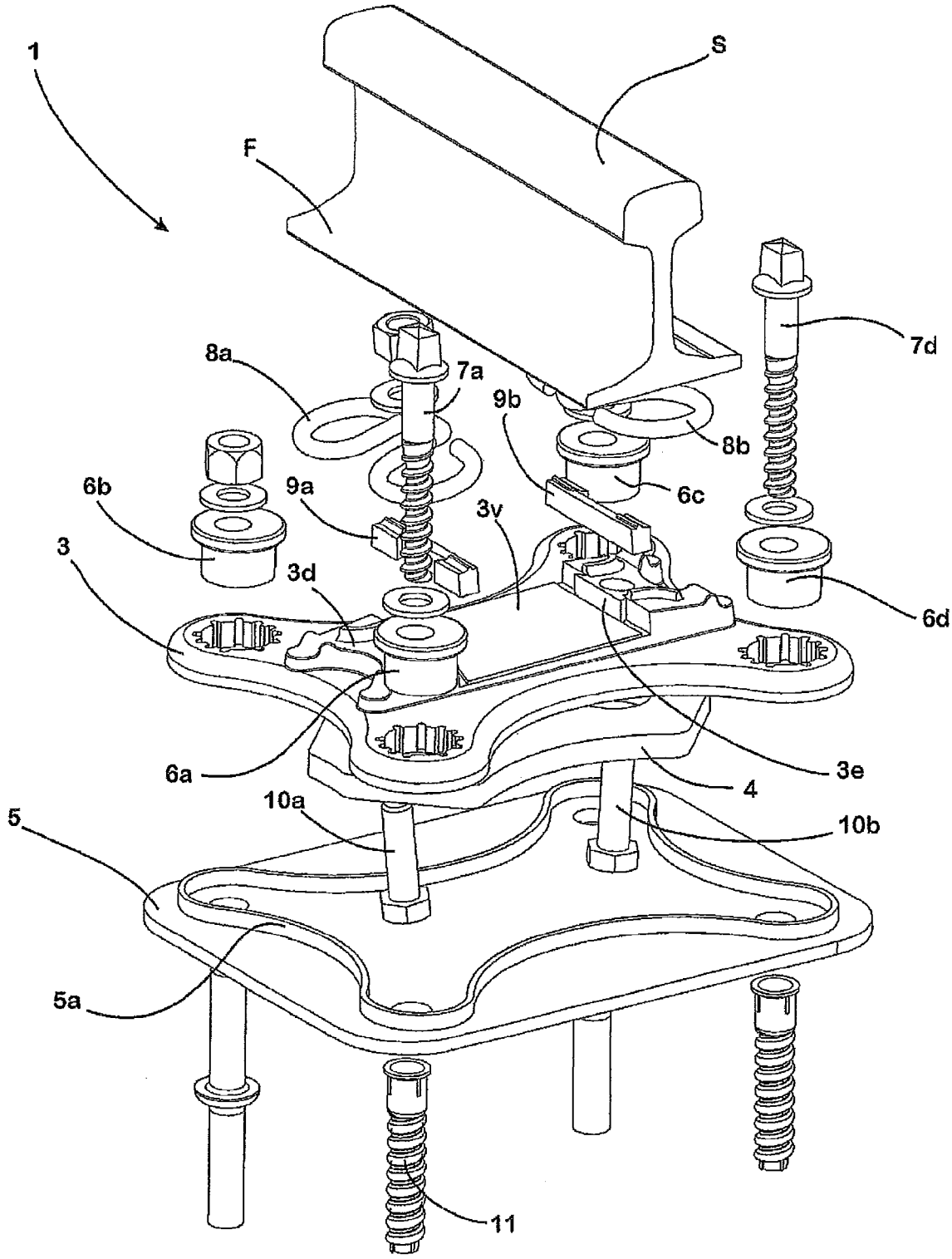
FIG. 1 is an exploded view of a system for fastening a rail in place.
Figure 2:
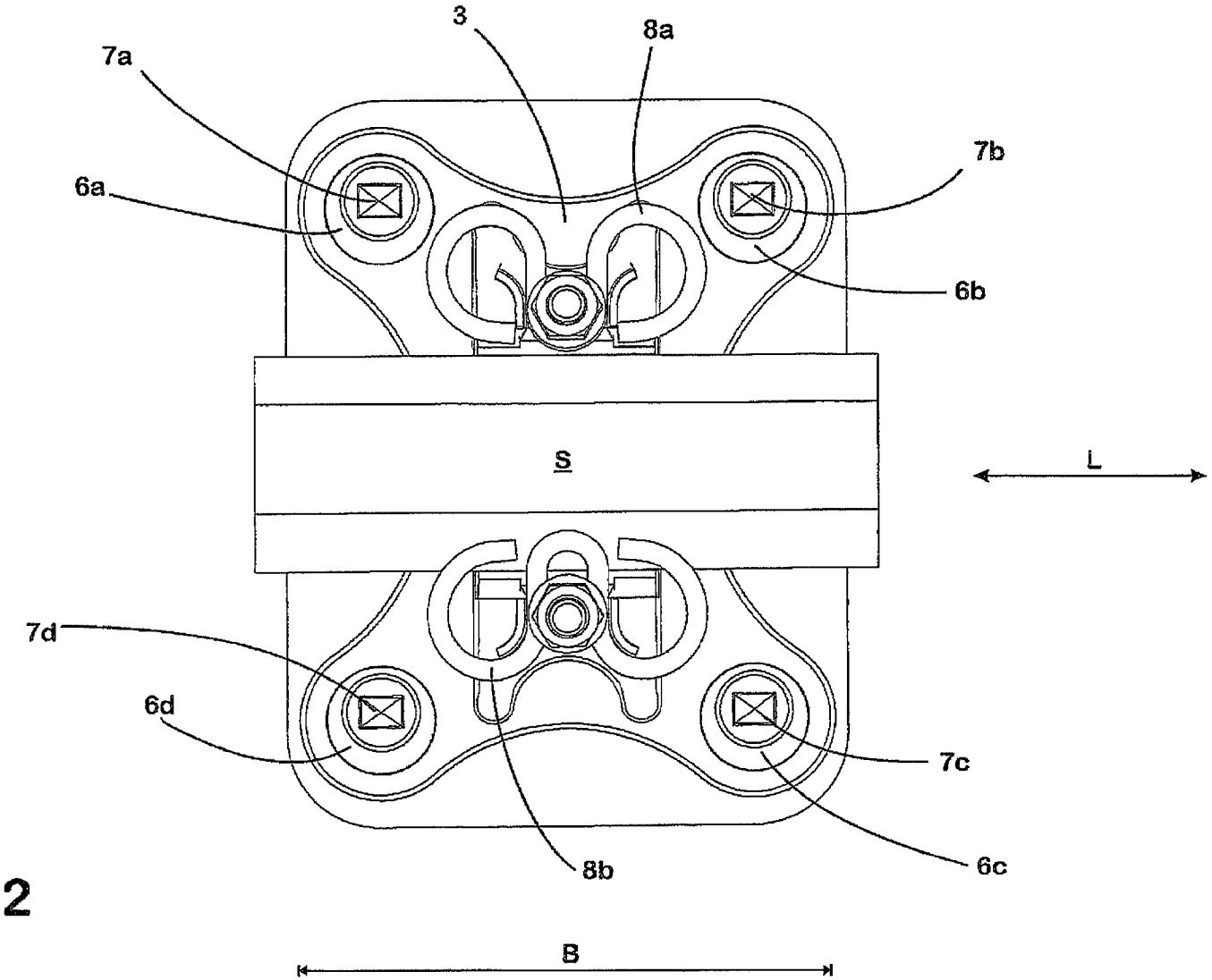
FIG. 2 is a plan view of the system in the fully installed position.
Figure 3:
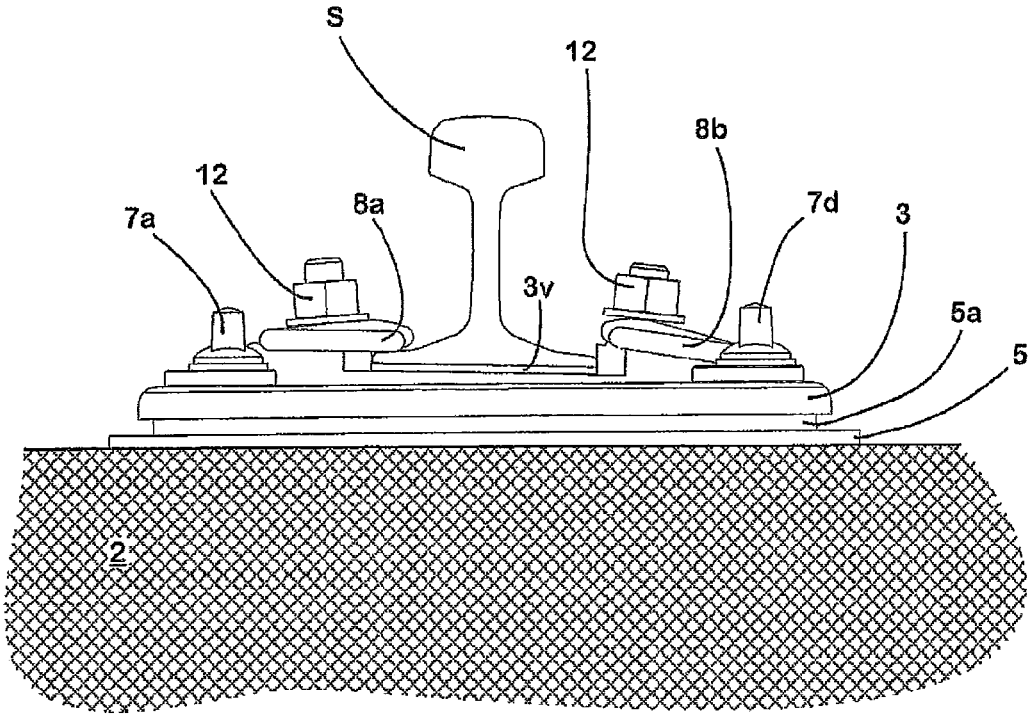
FIG. 3 is a view of the system from one side, in the fully installed position, looking in the longitudinal direction of the rail.
Figure 4:
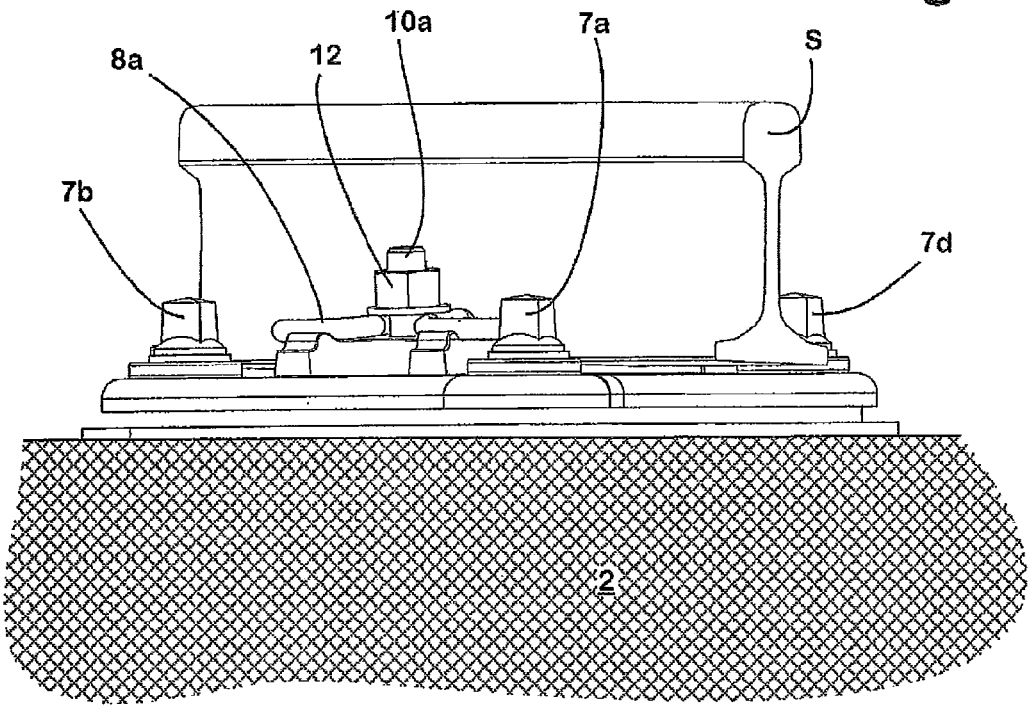
FIG. 4 is a perspective view of the system from one side in the fully installed position.
Figure 5:
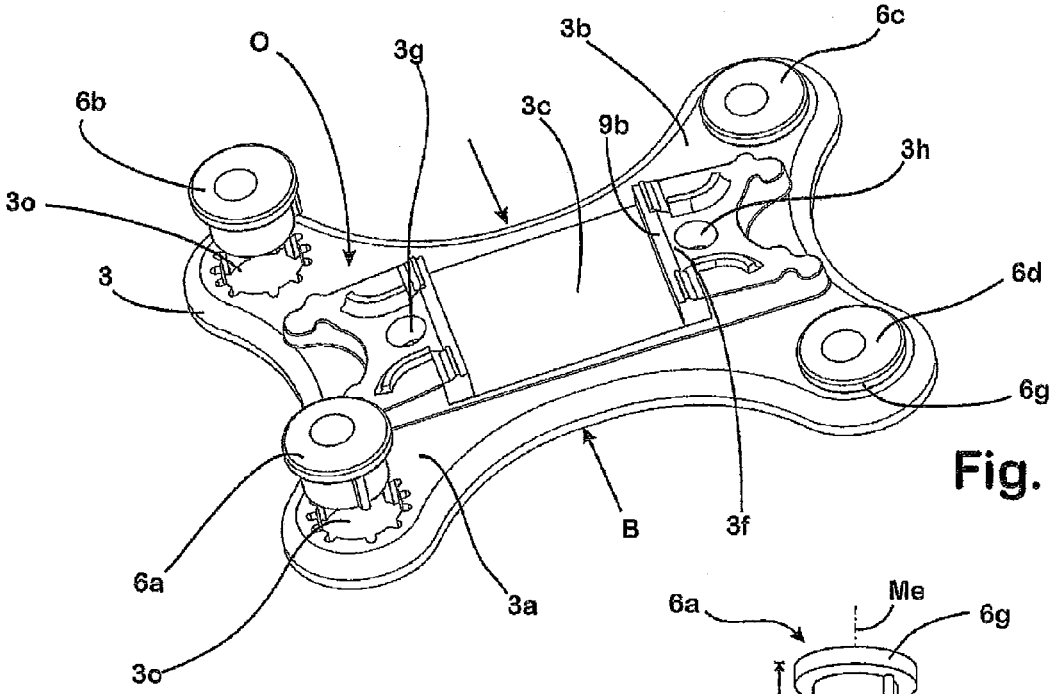
FIG. 5 is a perspective view from above of a base plate and associated eccentric sleeves.
Figure 7:
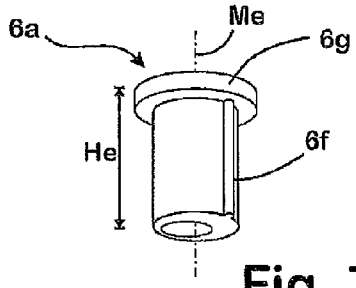
FIG. 7 is a perspective view of an eccentric sleeve.
Figure 6:
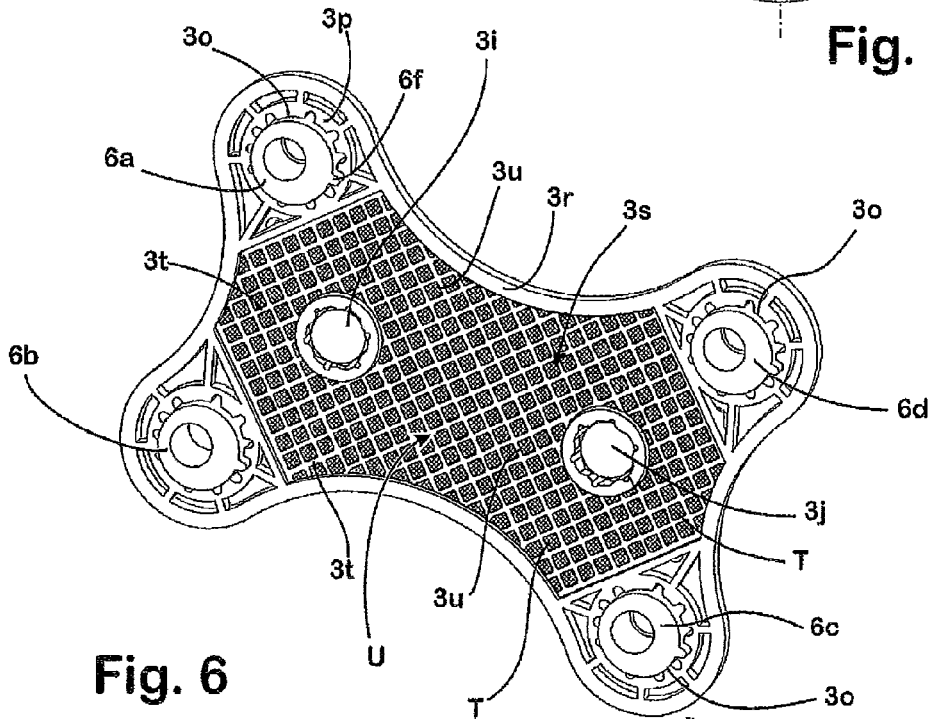
FIG. 6 is a perspective view from below of the base plate having eccentric sleeves inserted in it.

The system 1 for fastening a rail S to a fixed bottom support 2 which is formed in the present case by a concrete sleeper (not shown) comprises a base plate 3 made of a plastics material, an intermediate layer 4 made of an elastically yielding material which is to be arranged below the base plate 3, a carrier plate 5 which is to be arranged, below the intermediate layer 4, on the fixed bottom support 2, four eccentric sleeves 6*a*, 6*b*, 6*c*, 6*d* which have associated with them respective fastening bolts 7*a*, 7*b*, 7*c*, 7*d* which act as fastening members, two resilient members 8*a*, 8*b*, two adapter pieces 9*a*, 9*b*, and two clamping bolts 10*a*, 10*b*.

Seen in plan, the base plate 3 made of plastics material is of an elongated bone-like shape. Its outer regions 3*a*, 3*b* which adjoin respective ones of its narrow sides are of a considerably greater width B in this case, measured in the direction of the longitudinal extent L of the rail S which is to be fastened in place, than its central region, the change in the width B from the narrower central region to the adjoining wide lateral regions 3*a*, 3*b* taking place along a continuous step-free path.

In the central region, there is formed or moulded on the upper side O of the base plate 3 a supporting surface 3*c* which extends in the longitudinal direction L, which extends across whatever is the width B of the narrower central region of the base plate 3 in the given case, and which is bounded laterally relative to the narrow sides of the base plate 3 by respective shoulders 3*d*, 3*e*.

A dovetail-like projection 3*f* which projects towards the shoulder 3*d*, 3*e* situated opposite is formed on each of the faces for contact of the shoulders 3*e*, 3*d*, which faces for contact are associated with the supporting surface 3*c*. By a recess of complementary shape, respective ones of the adapter pieces 9*a*, 9*b* may be fitted onto these projections 3*f* in order, if required, to bridge a gap between the latter and the foot F of the rail S which is placed on the supporting surface 3*c* and in this way to ensure secure and reliable lateral guidance for the rail S.

Formed or molded in the shoulders 3*d*, 3*e*, in a position which is closely adjacent to the supporting surface 3*c* and central relative to the extent of the shoulders in the longitudinal direction L, are respective through-openings 3*g*, 3*h* which run from the upper side O of the base plate 3 to its underside U. Inserted through the through-openings 3*g*, 3*h* from the underside U of the base plate 3 are respective clamping bolts 10*a*, 10*b* which are configured after the fashion of a conventional hexagon-head bolt. The heads 10*c* of the clamping bolts 10*a*, 10*b* are seated in this case in respective receptacles 3*i*, 3*j* which are formed or moulded in the underside U of the base plate 3 and which are arranged in the region of the mouths of respective ones of the through-openings 3*g*, 3*h*.

The receptacles 3*i*, 3*j* are each surrounded by a circumferential wall 3*k* which is integrally connected to the base plate 3. In their respective circumferential surfaces associated with the receptacles 3*i*, 3*j*, there are formed on the circumferential walls 3*k* six faces for contact 31 which are distributed at equal angular intervals around the centres of the respective receptacles 3*i*, 3*j* and the length La of each of which, measured in the circumferential direction of the respective receptacles 3*i*, 3*j*, is less than half the length Ls of the side-faces 10*d* of the bolt head 10*c*. Formed or moulded in the given circumferential wall 3*k* between each pair of adjacent faces for contact 31 is a recess 3*m* which recedes into the circumferential wall 3*k* relative to the faces for contact 31. In the circumferential wall 3*k*, there is formed or moulded in addition in this case, adjacent to one of the faces for contact 31 which define each of the recesses 3*m*, a load-relieving recess 3*n* formed after the fashion of a groove, while the recess 3*m* merges into the other face for contact which defines it at a relatively shallow angle.

Figure 8:
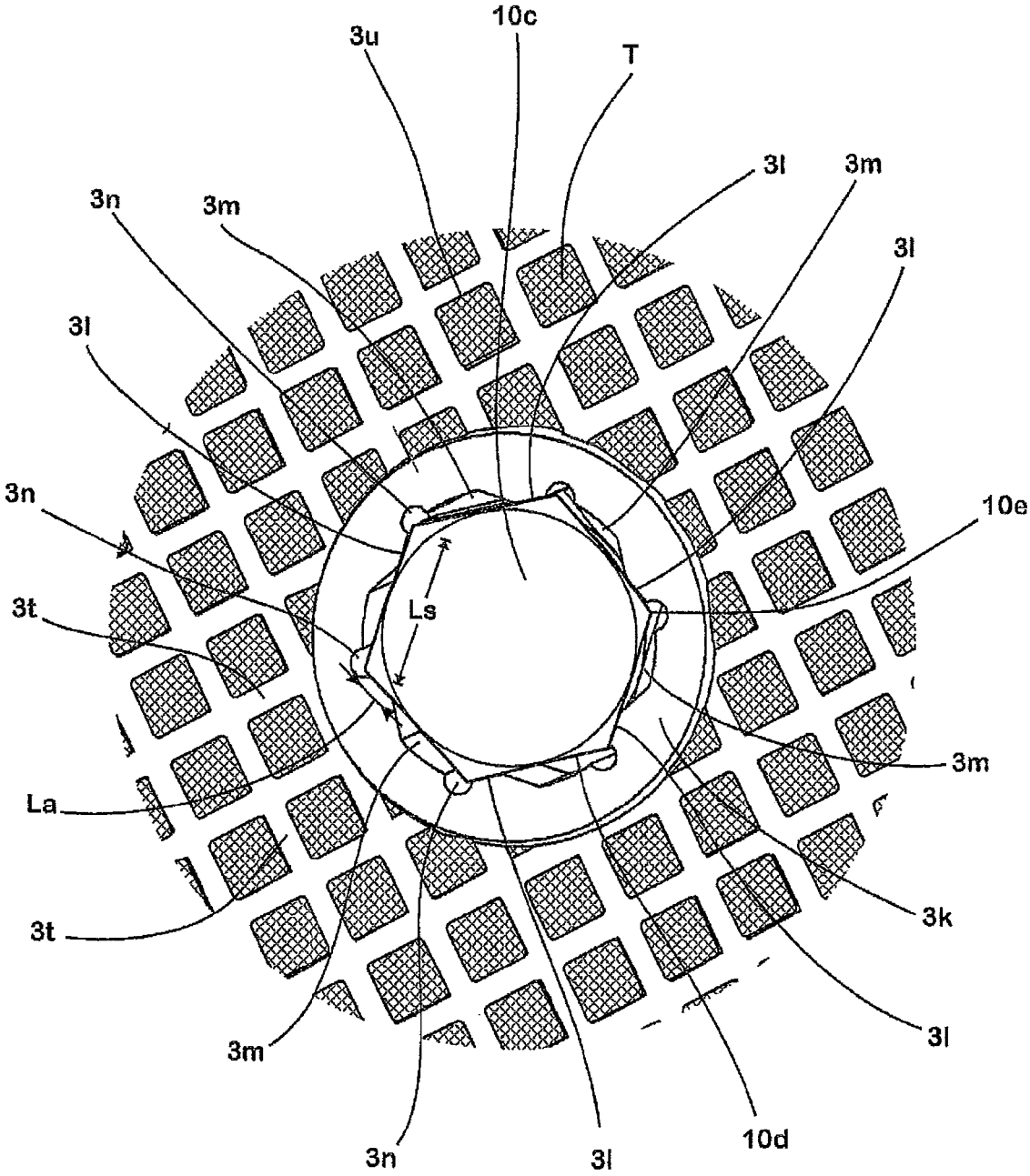
FIG. 8 is a perspective view from below showing a first enlarged detail of the base plate.
Figure 9:
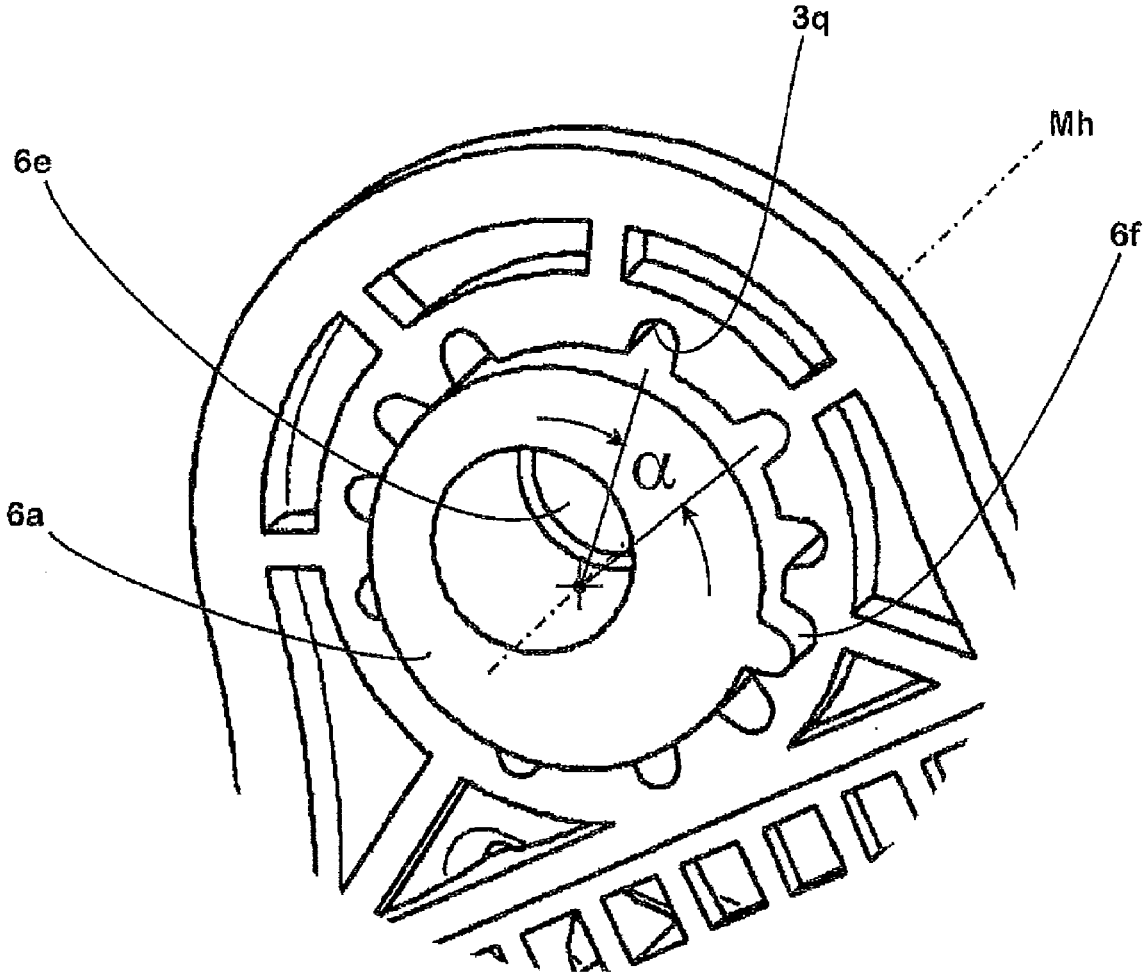
FIG. 9 is a perspective view from below showing a second enlarged detail of the base plate.

The regular distribution of the faces for contact 31, recesses 3*m* and load-relieving recesses 3*n* belonging to the respective receptacles 3*i*, 3*j*, and their position and dimensions, are selected in such a way that, in the fully installed position (FIG. 8), the side-faces 10*d* of the bolt head 10*c* bear against respective ones of the faces for contact 31 and each of the edges 10*e* of the bolt head 10*c* which are present between pairs of side-faces 10*d* is arranged in the region of a load-relieving recess 3*n* without being in contact with the given circumferential wall 3*k*.

In the same way, in the region of the recesses 3*m* there is no contact between the bolt head 10*c* and the given circumferential wall 3*k*, which means that it is only the faces for contact 31 which receive the torques acting on the bolt head 10*c* during installation and in practical operation. The bolt head 10*c* is prevented from cutting into the material of the circumferential wall 3*k* in the region of its edges 10*e* in this way, and any damage to or destruction of the circumferential wall 3*k* as a result of overloading is also prevented.

The base plate 3 is therefore able to withstand without any problems the torques which arise when the resilient members 8*a*, 8*b*, which take the form of a conventional ω-shaped clamping clip, are being braced. For the resilient members 8*a*, 8*b* to be braced, they are placed on the base plate 3 in such a way that the threaded shanks of the clamping bolts 10*a*, 10*b* respectively associated with them pass through the centre loops of the resilient members 8*a* and 8*b* respectively and the free resilient arms of the resilient members 8*a*, 8*b* rest on the foot F of the rail. Then, by means of nuts 12 which are screwed onto the respective threaded shanks, the centre loops of the resilient members 8*a*, 8*b* are pressed towards the base plate 3 until an adequate hold-down force is exerted on the foot F of the rail.

In the region of each of its corners, there is formed or moulded in the base plate 3 an opening 3*o* for a sleeve which runs from the upper side O of the base plate 3 to its underside U.

Seated in each of the four openings 3*o* for sleeves is one of the eccentric sleeves 6*a*-6*d* which are produced from a sufficiently strong material which is able to slide well when paired with the material of the base plate 3. These eccentric sleeves 6*a*-6*d* have a through-opening 6*e* which is eccentrically arranged relative to the centre axis Me of the given eccentric sleeve 6*a*-6*d*. Formed on the outer circumferential surface of each of the eccentric sleeves 6*a*-6*d* is a narrow indexable projection 6*f* whose axis extends parallel to the centre axis Me and which extends for the full height He of each of the eccentric sleeves 6*a*-6*d*. The eccentric sleeves 6*a*-6*d* are designed in this case to act as hold-down sleeves, for which purpose they have, at their upper edge associated with the upper side O of the base plate 3, a projection 6*g* which extends round in a circle after the fashion of a collar. In the fully installed state, the projection 6*g* from the eccentric sleeves 6*a*-6*d* bears against the upper side O of the base plate 3.

The four openings 3*o* for sleeves are each surrounded by a circumferential wall 3*p* which is formed by the plastics material of the base plate 3. Formed or moulded in the circumferential wall 3*p* at irregular angular intervals α are markers for indexing 3*q* which take the form of grooves, and whose axes extend parallel to the centre axis Mh of the given opening 3*o* for a sleeve, and whose shape is complementary to that of the indexable projection 6*f* which is formed on each of the eccentric sleeves 6*a*-6*d*.

The markers for indexing 3*q* and the openings 3*o* for sleeves are each so designed in this case that the eccentric sleeves 6*a*-6*d* respectively associated with them are guided in them by their indexable projections 6*f* as a sliding fit and with positive-fit, in such a way that the position in rotation of the eccentric sleeves 6*a*-6*d* in the openings 3*o* for sleeves associated with them is fixed but at the same time a relative movement between the base plate and the given sleeve 6*a*-6*d* directed in the direction defined by the centre axis Me is possible without any problems.

When the system 1 is being installed, one of the fastening bolts 7*a*-7*d* is inserted through the through-opening 6*e* in each of the eccentric sleeves 6*a*-6*d* and is screwed into the anchor 11 of plastics material which is inset into the fixed bottom support 2. In this way, the fastening bolts 7*a*-7*d* each create an axis of rotation about which the eccentric sleeve 6*a*-6*d* associated with them can be adjusted in rotation. Taking into account the eccentricity of the axis of rotation which is created in this way relative to the centre axis Mh of the given opening 3*o* for a sleeve, the angular intervals α between the markers for indexing 3*q* are of a size such that, when the base plate 3 is fully installed, each adjustment in rotation between two markers for indexing involves a displacement of the base plate 3 in a direction at right angles to the longitudinal extent of the rail S by a distance which is always of the same size. In this way, the angular intervals α may for example be so designed that each adjustment in rotation of the eccentric sleeves 6*a*-6*d* displaces the base plate 2 by one millimeter to allow the track gauge to be adjusted.

Integrally formed or moulded on the base plate 3, to extend round the edge of the base plate 3, is an apron-like projection 3*r* which points away from the underside U. The projection 3*r* acts as a stop for movements directed towards the fixed bottom support 2 which the base plate 3 makes when a railway vehicle (not shown) travels along the rail S standing on it.

Formed or molded into the base plate 3, in that region of the underside U which is not occupied by the openings 3*o* for sleeves and their circumferential walls 3*q* or by the receptacles 3*i*, 3*j*, is a stiffening structure 3*s* which is formed by ribs 3*t* which intersect at right angles and by depressions 3*u* which are arranged between them. The depressions 3*u* are filled in this case with a moulding material T which is lightweight but dimensionally stable. The filling T of moulding material terminates in this case substantially flush with the free top of the ribs 3*t* or projects beyond the top of the ribs for a distance of, typically, at least 2 mm, and there are thus no longer any sharp protruding edges of the ribs 3*t*.

So that the rail S is also supported elastically directly against the base plate 3, an elastic layer 3*v* which is composed of a permanently elastic plastics material is sprayed onto the supporting surface 3*c*. Alternatively, it is also possible for the elastic layer 3*v* to be formed by a pre-manufactured pad of elastic material which is placed down on the supporting surface 3*c* and which is in particular adhesively bonded thereto.

When seen in plan, the elastic intermediate layer 4 is of a shape which corresponds to the area occupied by the stiffening structure 3. When the system 1 is in the fully installed state, the stiffening structure 3 therefore completely covers the intermediate layer 4. This being so, even under the load applied by a railway vehicle travelling along the rail S, the filling T of filling material which is present in the depressions 3*u* of the stiffening structure 3*s* ensures that the ribs 3*t* of the stiffening structure 3*s* do not cut into the intermediate layer 4. Instead, the base plate 3 is always supported on the elastic intermediate layer 4 over such a large area that an optimum resilient action is maintained in the long term.

The thin carrier plate 5 which rests on the fixed bottom support 2 serves to protect the elastic intermediate layer against abrasive wear and dirt and ensures that there is an even surface for it to rest on. To secure the elastic intermediate layer in place on the carrier plate 5, a projection 5*a* which follows the outline shape of the elastic layer forms, on the upper side of the carrier plate 5, which upper side is associated with the base plate 3, a receptacle in which, when the system 1 is fully installed, the intermediate layer 4 is seated in positive-fit. In addition, the projection 5*a* also acts in this case as a stop which sets a limit to the movements of the base plate 3 directed towards the fixed bottom support 2 and which prevents any excessive compression of the elastic intermediate layer 4.

The elastic intermediate layer 4 is also protected against being too highly compressed when being installed by the fact that the height He of the eccentric sleeves 6*a*-6*d*, which are designed to act as hold-down sleeves and which stand on the carrier plate 5 in the fully installed state, is selected to be such that the base plate 3 is only pressed against the elastic intermediate layer 4 with a defined force even when the fastening bolts 7*a*-7*d* are fully tightened. If the force concerned is to be very low, the height He of an eccentric sleeve is selected to be one which corresponds to the thickness of the base plate 3 in the region of the openings 3*o* for sleeves plus the thickness of the elastic layer in the relaxed installed state, less the thickness of the projection 6*g*.

REFERENCE NUMERALS

α Angular intervals
1 System for fastening a rail S in place
2 Bottom support
3 Base plate
3*a*, 3*b* Outer regions of the base plate 3
3*c* Supporting surface of the base plate 3
3*d*, 3*e* Shoulders of the base plate 3
3*f* Projection
3*g*, 3*h* Through-openings
3*i*, 3*j* Receptacles in the base plate 3
3*k* Circumferential wall
3*l* Face for contact
3*m* Recess
3*n* Load-relieving recess
3*o* Opening for sleeve
3*p* Circumferential wall
3*q* Markers for indexing
3*r* Projection
3*s* Stiffening structure
3*t* Rib
3*u* Depression
3*v* Elastic layer
4 Elastic intermediate layer
5 Carrier plate
5*a* Projection
6*a*-6*d* Eccentric sleeves
6*e* Opening in sleeve
6*f* Indexable projection
6*g* Projection
7*a*-7*d* Fastening bolts
8*a*, 8*b* Resilient members
9*a*, 9*b* Adapter pieces
10*a*, 10*b* Clamping bolts
10*c* Bolt head
10*d* Side-face of bolt head 10*c*
10*e* Edge of bolt head 10*c*
11 Anchor of plastics material
12 Nut
B Width of the base plate 3 at respective points
F Foot of rail
He Height
L Longitudinal direction La Length
Ls Length
Me Centre axis of a given eccentric sleeve 6*a*-6*d*
Mh Centre axis of a given opening 3*o* for a sleeve
O Upper side of the base plate 3
S Rail
T Moulding material
U Underside of the base plate 3

The invention claimed is:

1. A base plate for fastening a rail to a fixed bottom support, comprising:

a through-opening which runs from an upper side of the base plate to an underside of the base plate, wherein the through-opening is adapted to insert a clamping bolt having a polygonal head with side-faces therethrough, from the underside of the base plate; and a receptacle formed or moulded in the underside of the base plate around the perimeter of the through-opening, wherein, in a fully installed state, the head of the clamping bolt is seated in the receptacle, wherein the receptacle comprises a circumferential side wall having contact faces formed thereon and associated with each side-face of the bolt head, wherein each contact face extends partially the length of an associated bolt head side-face, such that in the installed state, the contact faces provide planar support against the bolt head side-faces, wherein, the contact faces of the circumferential wall are arranged to be spaced apart from one another, such that first recesses are formed or moulded in the circumferential wall of the receptacle, between directly adjacent contact faces, and wherein, at a first recess, there is no contact between the bolt head and the circumferential wall of the receptacle, in the fully installed state.

2. The base plate according to claim 1, wherein an additional load-relieving recess is formed or moulded in the circumferential wall of the receptacle adjacent to each of the first recesses.

3. The base plate according to claim 1, wherein the contact faces each extend across less than half of an associated bolt head side-face.

4. The base plate according to claim 1, wherein the contact faces are cambered, such that the faces are curved in a direction of the centre of the through-opening.

5. The base plate according to claim 1, wherein the base plate is made of a plastics material.

6. A fastener for fastening a rail to a fixed bottom support, having a base plate formed in accordance with claim 1 and having a clamping bolt which has a polygonal head, which is slid through the associated through-opening from the underside of the base plate and which is seated in the given receptacle by its head, its side-faces being supported against respective contact faces of the circumferential wall of the receptacle.

7. The fastener according to claim 6, wherein the clamping bolt is formed after the fashion of a hexagon-head bolt.

8. The fastener according to claim 6, wherein a resilient member is provided which is braced against the base plate by means of a nut screwed onto the clamping bolt and which exerts an elastic hold-down force on a foot of the rail which is to be fastened in place.

9. The fastener according to claim 6, wherein an intermediate layer of an elastic material is arranged between the base plate and the fixed bottom support.

10. The fastener according to claim 9, wherein a carrier plate is arranged between the elastic intermediate layer and the fixed bottom support.

* * * * *